US006475039B1

(12) United States Patent
Despouys

(10) Patent No.: US 6,475,039 B1
(45) Date of Patent: Nov. 5, 2002

(54) ELECTRICAL CONNECTOR CONTACT PIN

(75) Inventor: Paul Jean-Bernard Despouys, Breancon (FR)

(73) Assignee: Radiall, Rosny-sous-Bois (FR)

( * ) Notice: Subject to any disclaimer, the term of this patent is extended or adjusted under 35 U.S.C. 154(b) by 0 days.

(21) Appl. No.: 09/622,831

(22) PCT Filed: Feb. 23, 1999

(86) PCT No.: PCT/FR99/00401

§ 371 (c)(1),
(2), (4) Date: Oct. 5, 2000

(87) PCT Pub. No.: WO99/44261

PCT Pub. Date: Sep. 2, 1999

(30) Foreign Application Priority Data

Feb. 24, 1998 (FR) ..... 98 02185

(51) Int. Cl.[7] ..... H01R 15/187
(52) U.S. Cl. ..... 439/843
(58) Field of Search ..... 439/843, 262, 439/217, 258, 177, 844, 845, 846; 606/86; 173/328

(56) References Cited

U.S. PATENT DOCUMENTS 3,072,880 A * 1/1963 Olsson
4,572,606 A * 2/1986 Neumann et al.
4,780,097 A * 10/1988 Piscitelli ..... 439/843
5,419,723 A * 5/1995 Villiers et al. ..... 439/843

FOREIGN PATENT DOCUMENTS

| | | | |
|---|---|---|---|
| EP | 0 090 549 | 10/1983 | ..... H01R/13/20 |
| GB | 2 274 749 | 8/1994 | ..... H01R/13/11 |

* cited by examiner

*Primary Examiner*—Renee Luebke
*Assistant Examiner*—Phoung Nguyen
(74) *Attorney, Agent, or Firm*—Schweitzer Cornman Gross & Bondell LLP

(57) ABSTRACT

A contact pin for an electrical connector comprises a body, a connector element, and a sheath, the connector element being maintained in the extension of the body by being coupled with a peg projecting from the front face of the body, the sheath being disposed around the connector element and maintained on the body by clamping an annular portion of the latter. At the peg end, connector element comprises an end for coupling with said pin, conformed such that the pin cannot fit inside the cross section of said coupling end, the connector element being capable of deforming elastically to enable its coupling end to friction fit onto the pin, the thus deformed connector element being unable to fit inside the cross section of the sheath.

8 Claims, 3 Drawing Sheets

$D_{T,ext.}$
$D_{T,int.}$
$D_P$
$D_{T,ext.}+D_P-D_{T,int.}$
$D_S$
VIII

ELECTRICAL CONNECTOR CONTACT PIN

The present invention relates to a contact pin for an electrical connector.

BACKGROUND OF THE INVENTION

Multi-pin electrical connectors generally comprise a large number of contact pins, each of which comprises a connecting end intended to co-operate with the connecting end of a contact pin of an associated multi-pin connector and a joining end intended to receive the lead of an electrical cable which is soldered, brazed or wrapped onto that end.

Contact pins are routinely produced in two parts, namely a front part constituting the connecting end and a rear part constituting the joining end, to enable different materials with suitable elastic and plastic properties to be used.

With such contact pins, a problem arises when interconnecting the front and rear parts, since said coupling must be carried out simply and rapidly and must result in good electrical contact by introducing a minimum amount of disturbance to the electrical signal transmitted by the pin.

OBJECTS AND SUMMARY OF THE INVENTION

The present invention aims to provide a novel contact pin formed in two parts which constitutes an original solution to the above problem.

A contact pin for an electrical connector is also Known from GB-A-2 274 749 or U.S. Pat. No. 4,780,097, comprising a body, a connector element, and a sheath, the connector element being maintained in an extension of the body by being coupled with a peg projecting from the front face of the body, the sheath being disposed around the connector element and maintained on the body by clamping to an annular portion of said body.

The present invention provides a contact pin of that type, wherein, on the peg side, the connector element comprises an end for coupling with the peg, conformed such that the peg cannot fit inside the cross section of said coupling end, the connector element being capable of deforming elastically to enable its coupling end to be friction fitted onto the peg, the thus deformed connector element being unable to fit inside the cross section of the sheath, and wherein the sheath and the peg are separated by a clearance which is larger than the thickness of the wall of the coupling end of the connector element.

In other words, in the contact pin of the invention, the connector element is imprisoned between the peg, which is integral with the body, and the sheath under conditions such that said connector element is elastically constrained by the peg and the sheath.

Since the sheath is actually firmly fixed to the body by a forced friction fit onto an annular portion of the body, the result is that the mechanical link between the connector element and the remainder of the contact pin is particularly reliable.

It should be understood that because the connector element undergoes elastic deformation only when it is placed in position between the peg and the sheath, the forces which are exerted firstly between the connector element and the sheath, and secondly between the connector element and the peg are due to the resilience of the connector element.

In other words, the connector element does not suffer plastic deformation which would reduce the forces which it exerts on the sheath and the peg by resilience.

A further essential advantage of the contact pin of the invention is that it can tolerate relatively high manufacturing tolerances, since the elasticity of the connector element can to a large extent compensate for any defects in dimensioning between the parts.

Thus, taking the manufacturing tolerances of the body of the connector element and the sheath into account, in a preferred embodiment, the contact pin of the invention can be defined as satisfying the following conditions:

$$D_{Text.max} \leq D_{Smin}$$

$$D_{Smin} - D_{Pmax} \geq 2 \cdot e_{max}$$

$$D_{Tint.max} < D_{Pmin}$$

$$D_{Pmin} - D_{Tint.max} > D_{Smax} - D_{Text.min}$$

where:

$D_{Text.max}$ is the maximum outside diameter of the connector element, taking manufacturing tolerances into account;

$D_{Text.min}$ is the minimum outside diameter of the connector element, taking manufacturing tolerances into account;

$D_{Tint.max}$ is the maximum inside diameter of the connector element, taking manufacturing tolerances into account;

$e_{max}$ is the maximum thickness of the connector element, taking manufacturing tolerances into account;

$D_{Smin}$ is the minimum inside diameter of the sheath, taking manufacturing tolerances into account;

$D_{Smax}$ is the maximum inside diameter of the sheath, taking manufacturing tolerances into account;

$D_{Pmax}$ is the maximum outside diameter of the pin, taking manufacturing tolerances into account;

$D_{Pmin}$ is the minimum outside diameter of the pin, taking manufacturing tolerances into account.

It goes without saying that the possibility of automatically compensating for manufacturing tolerances by the arrangement of the contact pin of the invention enables its different component parts to be manufactured employing simple and cheap manufacturing methods while the electrical qualities of the pin remain good.

In a particular embodiment of the invention, the connector element is dimensioned to allow it to slide freely in the sheath before undergoing the deformation resulting from friction fitting its coupling end on the peg.

In a preferred embodiment, the connector element has a longitudinal slot which enables it to pass from a closed position, in which the two edges of said slot touch each other, to an open position in which the two edges of said slot are spaced from each other, this open position resulting from deformation of said connector element Preferably, the connector element is in its closed position before undergoing the deformation resulting from friction fitting its coupling end on the peg.

Thus after positioning the sheath, the connector element is in a position which is close to its closed position, the two edges of the slit almost touching, with the result that once the connector element is in place in the contact pin, its shape can remain stable even after a large number of connections/disconnections, because only the interface portion proper deforms elastically.

In general, as is the case in the majority of known contact pins, the body, the connector element, and the sheath of the pin of the invention are all substantially bodies of revolution.

In a particular embodiment, the coupling end of the connector element has a circular cross section with an inside diameter which is smaller than the inside diameter of the circular cross section of the remainder of the connector element.

The present invention also provides a method of assembling a contact pin as described above.

Such a method consists in friction fitting the coupling end of the connector element on the peg of the pin body, then aligning the sheath with the deformed connector element, the sheath being maintained in a sleeve having inside dimensions which correspond substantially to the outside dimensions of the sheath, engaging the sheath maintained in the sleeve around the connector element using an axial translation movement until the sheath has completely overlaid the connector element, then displacing the sheath from the sleeve by keeping the sleeve stationary so as to bring said sheath to the annular portion of the body by axial translation, before retracting the sleeve.

The essential advantage of this method is that it comprises axial translation operations only, which facilitates automation.

BRIEF DESCRIPTION OF THE DRAWINGS

The invention will be better understood from the following description of an embodiment given by way of non-limiting example and made with reference to the following drawings in which.

MORE DETAILED DESCRIPTION

Figure 1:
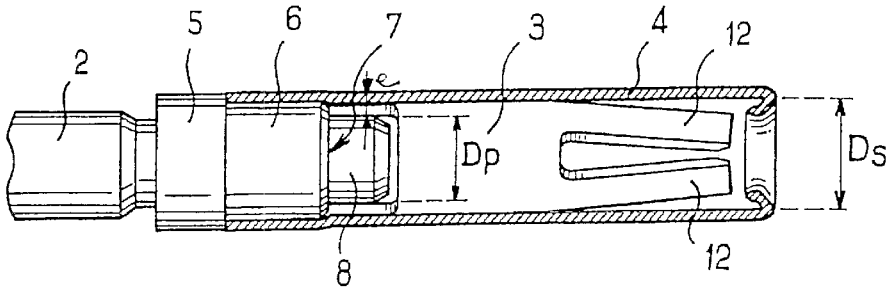
FIG. 1 is a longitudinal section through a contact pin of the invention.

Contact pin 1 shown in FIG. 1 comprises a body 2, a connector element 3 and a sheath 4.

The body is extended to the left by a coupling end (not shown) which can have different forms depending on its coupling to a lead. It may be a shank for crimping, an outlet onto which a lead can be wrapped, or a pin outlet for a printed circuit board.

At its end opposite from its coupling end, body 2 comprises a large diameter collar 5 which borders an annular portion 6 of smaller diameter provided to retain sheath 4.

A peg 8 projects from the front face 7 of the body, which face co-operates with collar 5 to define the annular portion 6. Peg 8 has circular cross section with diameter $D_P$ which is smaller than that of the annular portion 6, for receiving the connector element.

Body 2 is produced from brass, since it is a low cost material.

Connector element 3, which can be seen in more detail in FIGS. 2 to 6, is substantially in the form of a tube including a longitudinal slot 9.

In its closed position shown in FIGS. 2 to 6, 7A and 8A, i.e., in the position in which edges 10 of longitudinal slot 9 are touching, connector element 3 has an outside diameter $D_{Text}$ which is slightly smaller than the inside diameter $D_S$ of the sheath, such that in its closed position, the connector element can slide freely in the sheath.

At its front end, i.e., on the right in the figures, connector element 3 has four slots 11 which separate four elastic fingers 12 which bend inwardly in the direction of the axis of the connector element, intended to constitute a female connecting interface with a corresponding male contact pin (not shown).

Opposite this connecting interface, connector element 3 comprises an end 13 for coupling with the peg 8 of the body.

The coupling end 13 has a circular cross-section of inside diameter ($D_{Tint}$) that is smaller than the inside diameter of the circular cross-section of the rest of the body.

Figure 2:
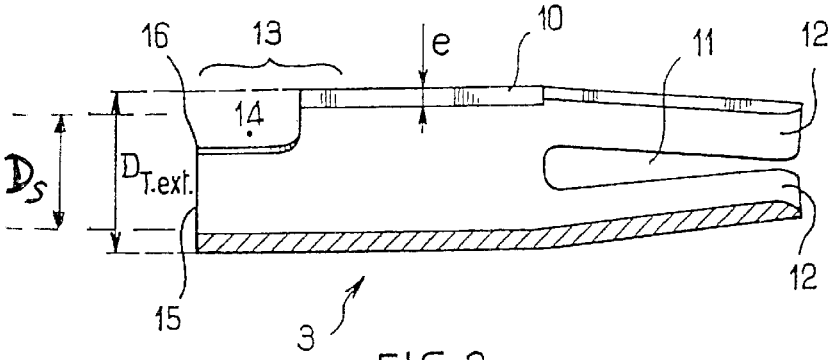
FIG. 2 is a larger scale view of a longitudinal section of the connector element of the pin of FIG. 1.
Figure 3:
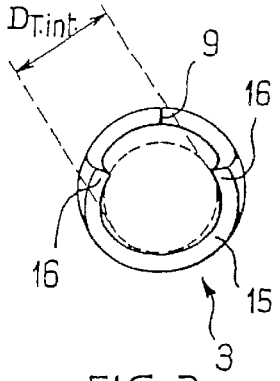
FIG. 3 is a view from the left of FIG. 2.
Figure 4:
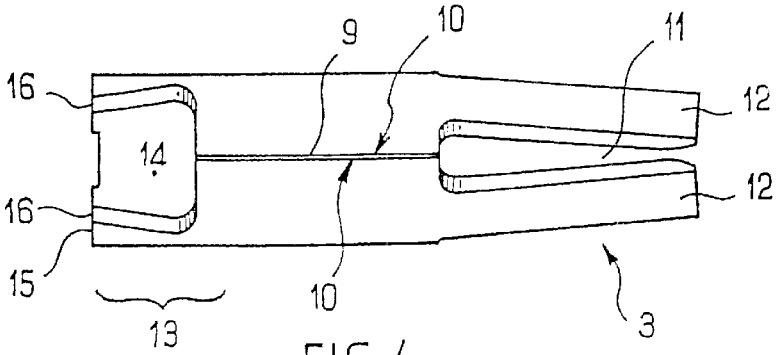
FIG. 4 is a view from the top of FIG. 2.
Figure 5:
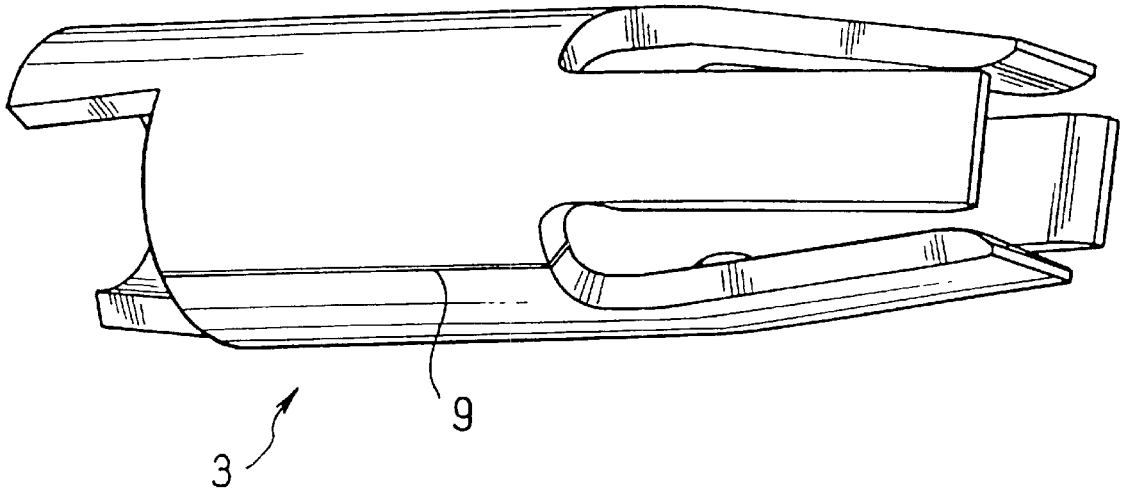
FIGS. 5 and 6 are perspective views of the connector element of FIG. 2.
Figure 6:
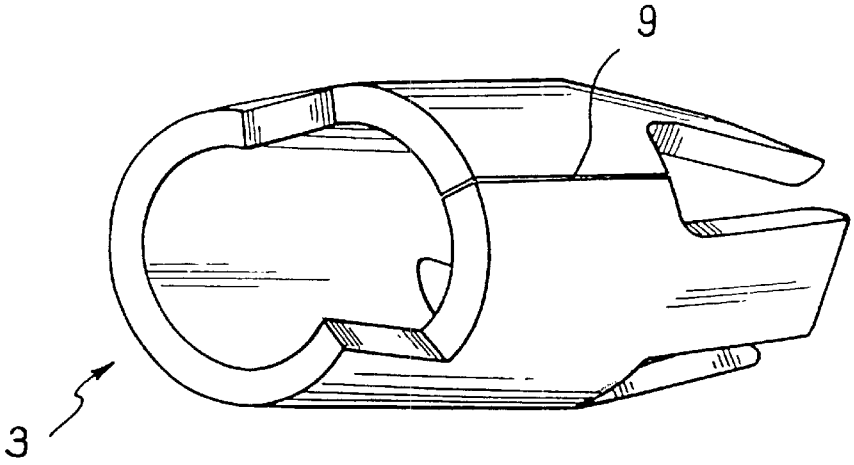

The shape of this coupling end 13 can be seen in more detail in FIGS. 2 to 4 which show that a cutout 14 formed in the wall of the connector element produces a section of a ring in the rear face 15, the two ends 16 of which are deformed inwardly of the connector element.

The wall of the connector element has the same thickness over its entire length, including its coupling end 13.

Figures 7A, 7B, 7C, 7D, 8A, 8B, 8C:
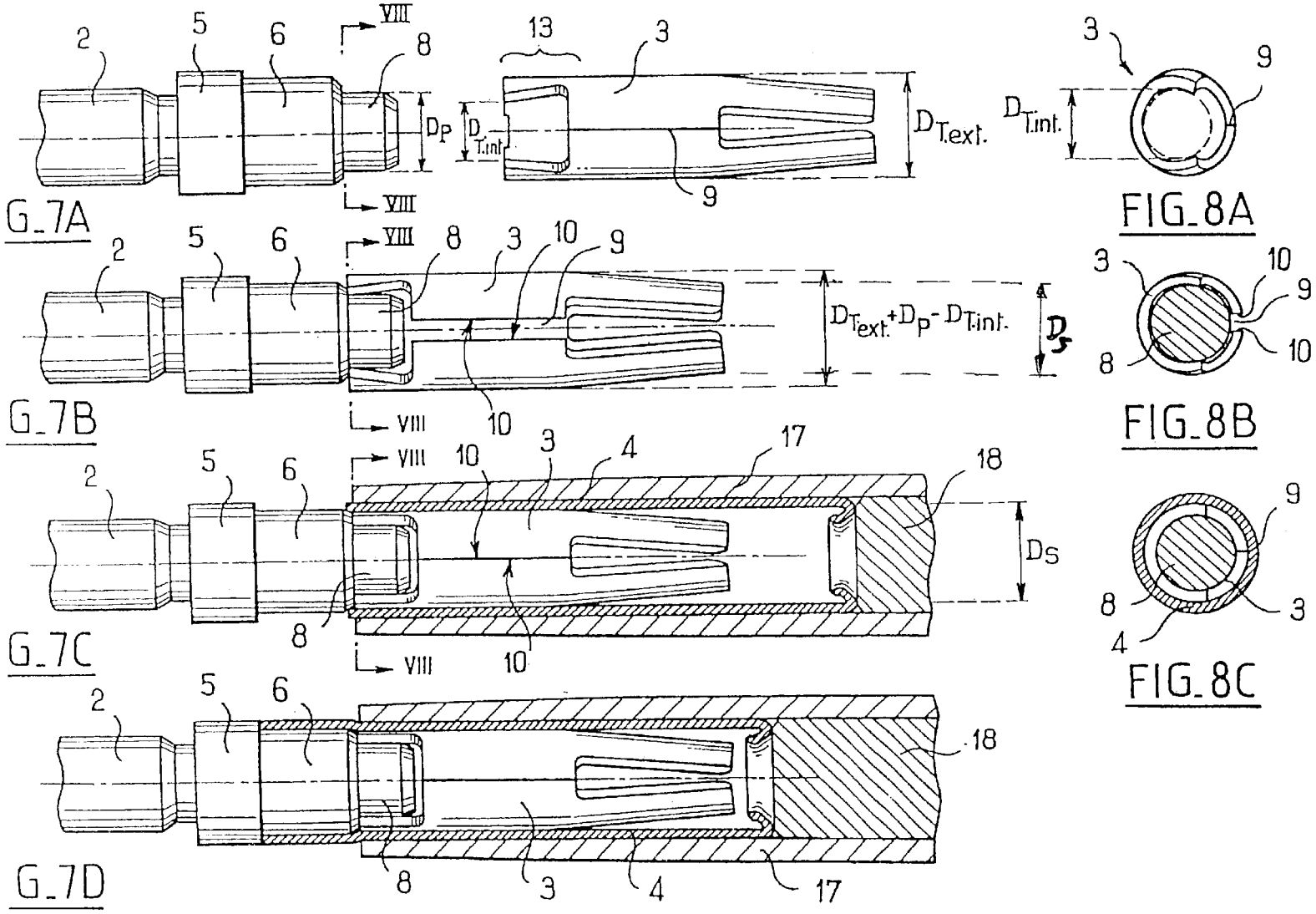
FIGS. 7A, 7B, 7C and 7D are sectional views of part of the contact pin during assembly.
FIGS. 8A, 8B and 8C are sectional views along VIII—VIII of FIGS. 7A, 7B and 7C.

As can be seen in FIGS. 3 and 8A, in the closed position of the connector element, the coupling end thus formed only leaves space for a cylindrical volume which is shown by a circle represented by dotted lines, which is inscribed inside the cross section of the coupling end.

The circle has a diameter $D_{Tint}$ which is less than that $D_P$ of the peg 8 projecting from the front face of the body.

As a result, peg 8 cannot fit into the cross section of the coupling end when the connector element is in the closed position.

The assembly of the pin of the invention is described with reference to FIGS. 7A to 7D and 8A to 8C.

As can be seen in FIGS. 72 and 8B, friction fitting of peg 8 of the coupling end 13 of the connector element 3 causes the connector element to deform, which then takes up an open position in which the two facing edges 10 of slot 9 are apart from each other.

In this open position, the outside diameter of connector element 3 increases by a value equal to the difference $D_P-D_{Tint}$ between the diameter of peg 8 and that of the circle inscribed inside the cross section of coupling end 13.

In other words, after the coupling end 13 has been friction fitted on the peg 8, the outside diameter of the coupling element is equal to $D_{Text}+D_P-D_{Tint}$.

The dimensions of the peg, the coupling element, and the sheath are selected such that the diameter of the connector element deformed by friction fitting on the peg is larger than the inside diameter $D_S$ of the sheath.

Thus if sheath 4 is aligned with connector element 3 and it is axially slid around this connector element 3 using a sleeve 17 which holds it firmly and in particular prevents it from deforming radially, the connector element is caused to clamp to a position close to its closed position in which the facing edges 10 of the longitudinal slot 9 are very close to each other, as can be seen in FIGS. 7C and 8C.

In this position, the radial clearance $D_S-D_P$ existing between the peg and the internal wall of the sheath is occupied by the coupling end of the connector element, elastically constrained between said sheath and said peg.

To prevent any creep in the pin, the connector element, or the sheath, so that engaging the sheath around the connector element results only in purely elastic deformation of the connector element, the dimensions of the various components of the contact pin are determined so that the radial clearance $(D_S-D_P)/2$ existing between the peg and the internal wall of the sheath is larger than the thickness e of the wall of the connector element.

Thus the connector element undergoes elastic deformation only and resiliently exerts radial pressure on the peg and on the sheath.

Once the connector element is completely overlaid by the sheath, sleeve 17 is stopped from advancing and axial displacement of sheath 4 is continued by pushing it in the direction of body 2 using a pusher 18, causing radial expansion of the sheath which is forcibly engaged on annular portion 6 of the body, until it abuts against collar 5.

The sheath is then fixed firmly to the body.

The connector element, which has undergone elastic deformations only, is also fixed firmly to the remainder of the contact pin, firstly because of its elastic contact with the sheath, and secondly because of its elastic contact with the peg.

It should be understood that the elasticity of the connector element can readily be used to compensate for the manufacturing tolerances of the body, whereby the diameter of the peg is in the range $D_{Pmin}$ and $D_{Pmax}$, the inside diameter of the sheath is in the range $D_{smin}$ to $D_{smax}$, the outside diameter of the connector element is in the range $D_{Text.min}$ to $D_{Text.max}$, and whereby the coupling end leaves space for a cylindrical volume with a diameter in the range $D_{Tint.min}$ to $D_{Tint.max}$.

What is claimed is:

1. A contact pin for an electrical connector comprising a body, a connector element, and a sheath, the connector element being maintained in an extension of the body by being coupled with a peg projecting from the front face of the body, the sheath being disposed around the connector element and maintained on the body by clamping an annular portion of said body, wherein, on the peg side, the connector element comprises an end for coupling with the peg, said connector element being capable of expanding elastically, said connection end being configured so as to be friction fitted onto the peg by causing an elastic expansion of the connector element, the thus deformed connector element having a cross section greater than a cross section of the sheath before coupling said sheath with said connector element, and wherein the sheath and the peg are separated by a clearance which is larger than the thickness of the wall of the coupling end of the connector element.

2. A contact pin according to claim 1, wherein the body, connector element and sheath satisfy the following conditions:

$$D_{Text.max} \leqq D_{Smin}$$

$$D_{Smin}-D_{Pmax} \geqq 2 \cdot e_{max}$$

$$D_{Tint.max} < D_{Pmin}$$

$$D_{Pmin}-D_{Tint.max} > D_{Smax}-D_{Text.min}$$

where:

$D_{Text.max}$ is the maximum outside diameter of the connector element, taking manufacturing tolerances into account;

$D_{Text.min}$ is the minimum outside diameter of the connector element, taking manufacturing tolerances into account;

$D_{Tint.max}$ is the maximum inside diameter of the connector element, taking manufacturing tolerances into account;

$e_{max}$ is the maximum thickness of the connector element, taking manufacturing tolerances into account;

$D_{Smin}$ is the minimum inside diameter of the sheath, taking manufacturing tolerances into account;

$D_{Smax}$ is the maximum inside diameter of the sheath, taking manufacturing tolerances into account;

$D_{Pmax}$ is the maximum outside diameter of the peg, taking manufacturing tolerances into account;

$D_{Pmin}$ is the minimum outside diameter of the peg, taking manufacturing tolerances into account.

3. A method for assembling a contact pin according to claim 1, the method consisting in friction fitting the coupling end of the connector element on the peg of the pin body, then aligning the sheath with the deformed connector element, the sheath being maintained in a sleeve the internal dimensions of which substantially correspond to the external dimensions of the sheath, engaging the sheath maintained in the sleeve around the connector element using an axial translation movement until the sheath has completely overlaid the connector element, then displacing the sheath in the sleeve by keeping the sleeve stationary to bring said sheath to the annular portion of the body by axial translation before retracting the sleeve.

4. A contact pin according to claim 1, wherein the body, connector element and sheath are substantially bodies of revolution.

5. A contact pin according to claim 4, wherein the connector element has a substantially cylindrical middle portion and wherein said coupling end (13) has a cross section which has a maximum diameter ($D_{Tint}$) circle inscribed within said cross section, said maximum diameter ($D_{Tint}$) being smaller than the inside diameter of said cylindrical middle portion cross section.

6. A contact pin according to claim 1, wherein, prior to deformation, the connector element can slide freely in sheath.

7. A contact pin according to claim 1, wherein the connector element comprises a longitudinal slot which enables it to pass from a closed position, in which the two edges of said slot touch each other, to an open position in which the two edges of said slot are spaced from each other, this open position resulting from deformation of said connector element.

8. A contact pin according to claim 7, wherein, prior to deformation, the connector element is in its closed position.

* * * * *